US006101813A

United States Patent [19]

Sami et al.

[11] Patent Number: 6,101,813

[45] Date of Patent: Aug. 15, 2000

[54] ELECTRIC POWER GENERATOR USING A RANKING CYCLE DRIVE AND EXHAUST COMBUSTION PRODUCTS AS A HEAT SOURCE

[75] Inventors: Samuel M. Sami, Moncton; Jean-Guy Chouinard, Verdun; David Elkaim, St. Laurent, all of Canada

[73] Assignee: Moncton Energy Systems Inc., New Brunswick, Canada

[21] Appl. No.: 09/055,937

[22] Filed: Apr. 7, 1998

[51] Int. Cl.[7] ..... F01K 25/00

[52] U.S. Cl. ..... 60/671; 60/651

[58] Field of Search ..... 60/651, 653, 671, 60/679

[56] References Cited

U.S. PATENT DOCUMENTS

| | | | |
|---|---|---|---|
| 3,016,712 | 1/1962 | Taylor | 60/679 |
| 3,277,651 | 10/1966 | Augsburger | 60/679 |
| 4,055,049 | 10/1977 | Murphy et al. | 60/651 |
| 4,651,531 | 3/1987 | Enjo et al. | 60/651 |
| 4,651,533 | 3/1987 | Ura et al. | 60/657 |
| 4,896,509 | 1/1990 | Tomura et al. | 60/671 |
| 5,221,493 | 6/1993 | Merchant et al. | 60/651 |
| 5,277,834 | 1/1994 | Bivens et al. | 60/651 |
| 5,442,908 | 8/1995 | Briesch et al. | 60/39.182 |
| 5,548,957 | 8/1996 | Salemie | 60/651 |
| 5,603,218 | 2/1997 | Hooper | 60/651 |
| 5,850,739 | 12/1998 | Masnoi | 60/679 |
| 5,910,100 | 6/1999 | Hooper | 60/651 |

*Primary Examiner*—Noah P. Kamen
*Attorney, Agent, or Firm*—Swabey Ogilvy Renault; Guy J. Houle

[57] ABSTRACT

An electric power generating system and method of operation is comprised of a waste-heat boiler adapted to a Rankine cycle provided with turbines for driving an electric generator. The waste-heat boiler uses exhaust combustion products from a fuel-fired device as a thermal heat source for vapor regeneration of an organic heat exchange fluid mixture used in the Rankine cycle.

11 Claims, 1 Drawing Sheet

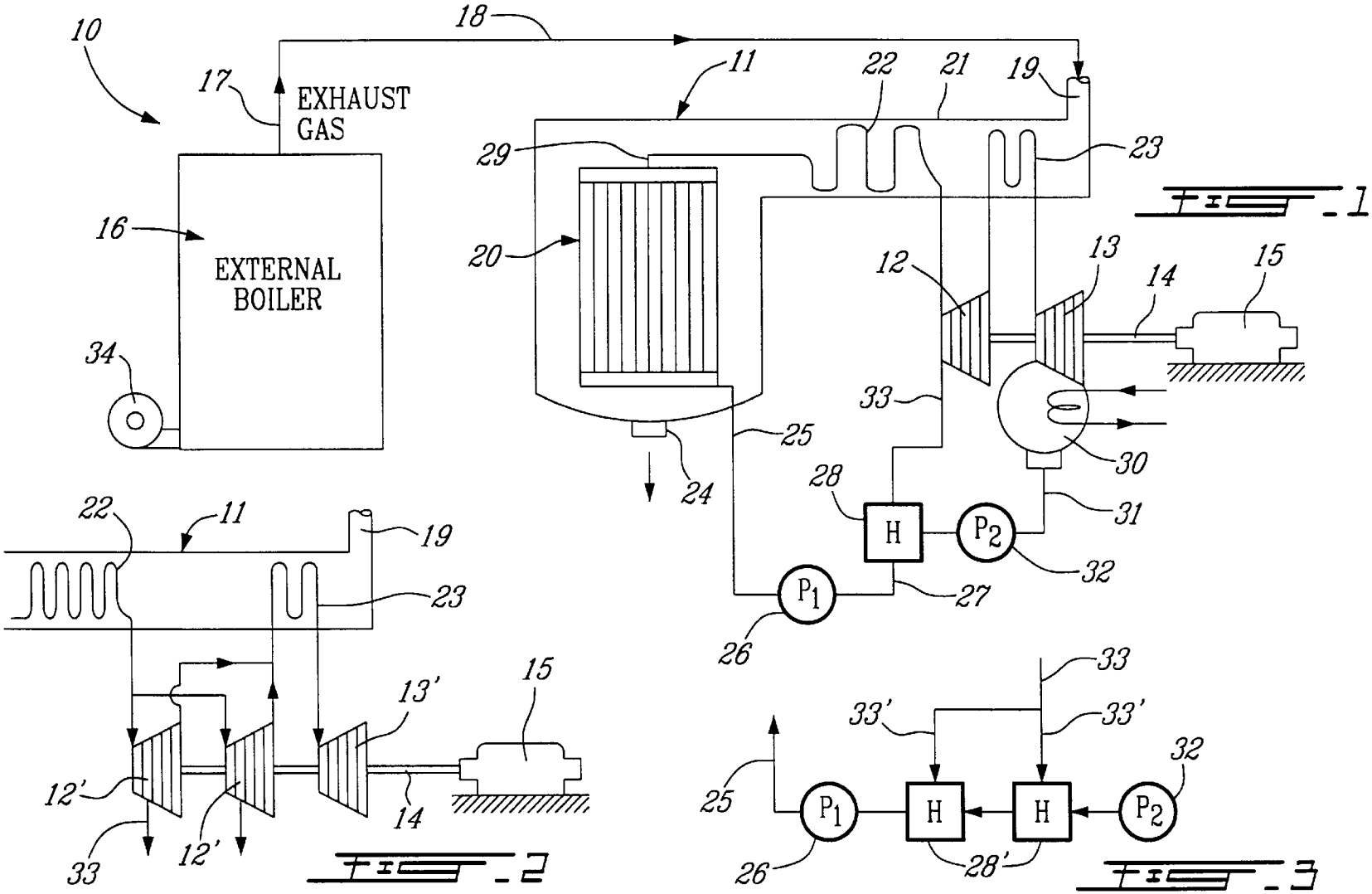
EXHAUST GAS
EXTERNAL BOILER
H
P1
P2

ELECTRIC POWER GENERATOR USING A RANKING CYCLE DRIVE AND EXHAUST COMBUSTION PRODUCTS AS A HEAT SOURCE

TECHNICAL FIELD

The present invention relates to an electric power generating system and method of operation which uses a waste-heat boiler adapted to a Rankine cycle drive and wherein the thermal heat source for the boiler to provide vapour regeneration of an organic heat exchange fluid mixture is provided by exhaust combustion products of a fuel-fired device.

BACKGROUND ART

There is a need to provide electric power which is economical and reliable. There is also a need to provide electric power from sources of energy which are not dependent themselves on electric power to run component parts thereof but can also operate on electric grid in case of a failure of their own electrical power operating system. There is also the need to provide electric power during periods of transmission line power failures whereby to maintain electrically-dependent equipment operative. There is also a need to recover energy loss through exhaust combustion products of fuel-fired boilers, for example and to convert to reusable energy.

SUMMARY OF INVENTION

It is therefore a feature of the present invention to provide an electric power generating system and method of operation which fulfills the above-mentioned needs.

According to a broad aspect of the present invention, there is therefore provided an electric power generating system using an organic mixture which comprises a waste-heat boiler which is adapted to a Rankine cycle to power turbines for driving an electric generator. The waste-heat boiler uses exhaust combustion products from a fuel-fired device as a thermal heat source for vapour regeneration of an organic heat exchange fluid mixture at temperatures higher than 90° C.

Another feature of the present invention is to provide a method of generating electric power using an organic mixture and which comprises feeding a waste-heat boiler adapted to a Rankine cycle, with exhaust combustion products from a fuel-fired device providing the thermal heat source for vapour regeneration of an organic heat exchange fluid mixture at a temperature higher than 90° C. circulated in a closed circuit for driving turbines of the Rankine cycle, the turbines being connected to a drive shaft of an electric generator.

BRIEF DESCRIPTION OF DRAWINGS

The preferred embodiments of the present invention will now be described with reference to the drawings in which FIG. 1 is a schematic illustration of an electric power generating system constructed in accordance with the present invention;

FIG. 2 is a schematic diagram illustrating a plurality of turbines being connected in series to drive an electrical generator; and FIG. 3 is a further schematic diagram illustrating two or more regenerative heaters connected in series in the Rankine cycle circuit.

DESCRIPTION OF PREFERRED EMBODIMENTS

Referring now to the drawings and more particularly to FIG. 1, there is shown generally at 10 the electric power generating system of the present invention. It is comprised of a waste-heat boiler 11 which is adapted to equipment normally found in a Rankine cycle to power turbines, herein a high pressure turbine 12 and a lower pressure turbine 13, which are connected to a common drive shaft 14 of an electric generator 15 whereby to generate electric power. The turbines 12 and 13 are also equipped with entrance nozzles 35 and 35', respectively, to enhance the inlet vapour velocity. In the electric power generating system of the present invention, the waste-heat boiler 11 uses exhaust combustion products from a fuel-fired device, such as an external boiler 16, as hereinshown, as a source of heat for vapour regeneration of an organic heat exchange fluid mixture. It is pointed out that the fuel-fired device can be a furnace, dryer, thermal combustion engine, turbine, fuel cell, or other such devices which generate hot products of combustion or reaction.

As herein shown, the outlet 17 of the external boiler is connected via suitable ducting 18 to an inlet 19 of the waste-heat boiler 11. The products of combustion are convected through the waste-heat boiler 11 and pass through a duct segment 21 where reheat exchanger 23 and a super-heat exchanger 22 are provided, whose purpose will be described later. The products of combustion then pass through an evaporator 20 and an economizer 36 to heat the liquid organic fluid mixture and the cooled products of combustion are then evacuated through the outlet duct 24. of course, the waste-heat boiler may be arranged whereby the products of combustion enter at the bottom and rise through the boiler 11 to exit at the top.

The organic fluid mixture to be heated is fed to the waste-heat boiler 11 through an inlet conduit 25 by a pump 26 which is connected to the outlet 27 of a regenerative heater 28. The organic heat exchange fluid mixture at the inlet 25 is in a liquid saturated state and at a temperature of about 70° C. This liquid saturated fluid passes through the economizer 36 where it is heated and then the evaporator 20 where it absorbs heat from the products of combustion passing through the boiler 11. At the outlet 29 of the evaporator 20, the heat exchange fluid mixture is in the form of a saturated vapour and it is then fed to a super-heat exchanger 22, in contact with the hot products of combustion, where the temperature of the fluid rises to a maximum of approximately 90° C. and changes to super-heated vapour. This super-heated organic fluid vapour mixture is then fed to the nozzle 35 of the high-pressure turbine 12 where it drives the turbine blades connected to the drive shaft 14.

In the high-pressure turbine 12 some of the vapour of the super-heated fluid mixture, which has now cooled, is extracted and fed through a reheat exchanger coil 23 for reheating by the hot products of combustion entering the boiler 11. This reheated vapour is now a low-pressure vapour and is used to drive the low-pressure turbine 13. As can be seen, the-low pressure turbine 13 is also connected to the drive shaft 14 of the electric generator 15 to assist the drive.

The organic heat exchange fluid mixture leaving the low pressure turbine 13 is in a saturated vapour state and fed to a condenser 30 which condenses the saturated vapour into its liquid phase and it exits the condenser at a temperature of about 60° C. The outlet 31 of the condenser 30 is fed to a pump 32 which pumps this liquid heat exchange fluid mixture fed thereto by the outlet conduit 33 of the high-pressure turbine 12. This mixture of heat exchange fluids, at different temperatures, causes the temperature of the fluid mixture from the condenser to rise and it exits the regenerative heater at about 70° C. where it is pumped to the inlet 25 of the waste-heat boiler and the entire cycle repeats itself.

The external boiler 16 is provided with a fuel-fired burner 34 which could be a natural gas or oil burner or any other form of burner capable of producing a flame whereby combustion products are generated.

FIGS. 2 and 3 illustrate modifications of the Rankine system wherein more than two turbines 12' and 13' may be connected to the drive shaft 14 and driven by the organic heat exchange fluid pressure.

Further, as shown in FIG. 3, there may be connected two or more regenerative heaters 20' and each of which would be fed with the liquid saturated hot vapours from the outlet conduit 33' of the high-pressure turbine whereby to provide a cascade arrangement of regenerative heaters 20' to increase the temperature of the saturated liquid to be fed to the inlet 25 of the waste-heat boiler 11.

The Rankine cycle turbines 12 and 13 are fully driven by the waste-heat boiler 11 using products of combustion from fuel-fired devices, such as boilers, and there is no need for any other thermal heat source. It is further pointed out that the heat exchange organic mixture is a multi-component mixture which enables the system to generate electricity at low temperatures and pressures. This is an important aspect of the present invention which permits the construction of the system in a much more economic manner as we are not concerned with problems inherent with high-pressure containers. The maximum super-heated mixture temperature is about 90° C. and the return liquid temperature to the waste heat boiler 11, at the inlet conduit 25 is at about 60° C. The inlet and outlet vapour conditions at the waste-heat boiler 11 insure that the Rankine cycle operates at low risk pressures and temperatures and will also consume the minimum heat from the waste-heat boiler 11. Accordingly, the boiler efficiency is not compromised. The regenerative heater 28 enhances the thermal efficiency of the organic Rankine cycle. By using multi-stage turbines the efficiency of the system can also be enhanced. However, the total number of regenerative heaters and turbine stages are determined by the economic viability of the unit to generate electricity.

The heat exchange organic mixture used in the Rankine cycle is an HCFC and/or HFC base and no CFCs are used. The selection of the mixture components depends on the boiling temperature and pressure of the mixture and the ability to produce higher thermal energy between about 60° C. to about 90° C. The organic heat exchange fluid mixture can also be binary, ternary, or quaternary mixtures. From experience, it has been found that a quaternary mixture produces the best benefits for an environmentally sound low-pressure system.

In order to determine the proper organic mixture, the cycle performance has been evaluated using various organic fluids and mixtures. The results are presented in Table −1, where the pressure and enthalpies as well as the enthalpy drop between 60° C. and 90° C. is shown. It is calculated that a quaternary mixture HFC134a/HCFC123/HCFC124/HFC125 with a composition of 10/70/10/10% by weight, produces a total work at the turbine of 54.05 kj/kg between 90° C. and 65° C. with 178.4 kj/kg of waste heat energy at the boiler. This produces a cycle efficiency of 30.3% using the proposed system. The cycle efficiency is defined as the energy gained divided by the heat consumed and available at exhaust gas.

Table −2 presents a comparative study between the various organic mixtures. Based on the environmental information available on the components of the organic mixture R134a/R123/R124/R125, it is believed that the mixture is environmentally sound. Furthermore, as shown in Table −1, the pressure ratio under the operating conditions is acceptable and the system is not considered as a high pressure vessel. Therefore, the proposed system is acceptable for all typical applications of fired fuel devices.

TABLE −1

| | Pressure | | Enthalpy | | |
|---|---|---|---|---|---|
| Refrigerant | 60° C. | 90° C. | 60° C. | 90° C. | $\Delta H_{90-60}$ |
| R-114 (pure) | 83.18 | 155.7 | 202.7 | 217.4 | 14.7 |
| R-123 (pure) | 41.46 | 90.53 | 255.2 | 273.2 | 18.0 |
| R-124 (pure) | 38.55 | 84.77 | 253.5 | 270.1 | 16.6 |
| R-125 (pure) | 144.5 | 282.0 | 234.5 | 245.9 | 11.4 |
| R-142b (pure) | 128.4 | 252.5 | 297.6 | 309.2 | 11.6 |
| R-134a (pure) | 98.8 | 208.1 | 408.3 | 425.7 | 17.4 |
| R-11 (pure) | 45.45 | 95.84 | 245.2 | 259.1 | 13.9 |
| R-141b (pure) | 35.56 | 77.97 | 312.7 | 331.9 | 19.2 |
| R-124/R-123 (10/90) | 45.45 | 95.84 | 245.2 | 259.1 | 5.6 |
| R-124/R-123 (20/80) | 35.56 | 77.97 | 312.7 | 331.9 | 6.6 |
| R-124/R-123 (30/70) | 45.16 | 98.56 | 249.5 | 255.1 | 6.5 |
| R-124/R-123 (40/60) | 49.64 | 108.1 | 248.5 | 255.1 | 7.3 |
| R-124/R-123 (50/50) | 68.84 | 148.0 | 244.5 | 260.7 | 16.2 |
| R-124/R-123 (60/40) | 78.15 | 166.6 | 243.0 | 258.5 | 15.5 |
| R-124/R-123 (70/30) | 89.72 | 189.0 | 241.0 | 256.0 | 15.0 |
| R-124/R-123 (80/20) | 104.2 | 215.8 | 238.9 | 252.9 | 14.0 |
| R-124/R-123 (90/10) | 122.2 | 247.4 | 236.2 | 249.1 | 12.9 |
| R-123/R-134m (70/30) | 64.3 | 141.5 | 265.2 | 281.3 | 16.1 |
| R-134g/R-124/R-123 (10/10/80) | 52.3 | 114.5 | 254.5 | 271.1 | 16.5 |
| R-134a/R-123/R-124/R-125 (10/70/10/10) | 60.7 | 133.2 | 252.5 | 268.9 | 16.4 |

TABLE −2

| | Comparative study between organic mixtures | | | | | | | | |
|---|---|---|---|---|---|---|---|---|---|
| No. of Heaters | 1 | | | 2 | | | 3 | | |
| Refrigerant | W | Q | η | W | Q | η | W | Q | η |
| R123/R134a (70/10%) | 36.8 | 177.9 | 20.7 | 34.7 | 177.9 | 19.2 | 18.5 | 172. | 10.2 |
| R134a/R123/R124 (10/80/10%) | 35.2 | 174.3 | 20.2 | 33.6 | 174.3 | 19.3 | 33.9 | 174.3 | 19.5 |
| R134a/R123/R124/R125 (10/70/10/10%) | 54.1 | 178.4 | 30.3 | 43.5 | 178.4 | 24.4 | 41.6 | 172.5 | 24.1 |

Units of W and Q are in kj/kg

Those skilled in the art will appreciate that the conception, upon which this disclosure is based, may readily be utilized as a basis for the redesigning of other structures, methods and systems for carrying out the several purposes of the present invention. It is important, therefore, that the claims be regarded as including such equivalent constructions insofar as they do not depart from the spirit and scope of the present invention.

We claim:

1. An electric power generating system using a quaternary refrigerant organic mixture of HFC134a, HCFC123, HCFC124 and HFC125 with proportions of 10% 70% 10% and 10%, by weight respectively, and comprising a waste-heat of exhaust combustion products of a fuel-fired furnace adapted to a Rankine cycle to power turbines for driving an electric generator, said waste-heat boiler using exhaust combustion products from a fuel-fired device as a thermal heat source for vapor regeneration of an organic heat exchange fluid mixture at temperatures higher than 90° C.

2. An electric power generating system as claimed in claim 1 wherein said waste-heat boiler has an evaporator through which is pumped said organic fluid mixture from a fluid circuit to absorb heat from said exhaust combustion products fed through an economizer to heat up said organic heat exchange fluid mixture and then through said evaporator to produce saturated vapour, said mixture exiting said evaporator being fed to a super-heat exchanger to produce super-heated gas from said saturated vapour to drive a high-pressure turbine equipped with entrance nozzles which enhance the entrance vapour velocity, and a reheat exchanger being provided to reheat extracted gas vapour from said high-pressure turbine to drive a low-pressure turbine; said high-pressure turbine and low-pressure turbine being connected to a common drive shaft of said electric generator.

3. An electric power generating system as claimed in claim 2 wherein low-pressure vapour exits said low-pressure turbine and is convected through a branch of said fluid circuit to a condenser where said low-pressure vapour is condensed to liquid form and pumped to a regenerative heater where it is heated by mixing with higher temperature fluid fed to said regenerative heater from said high-pressure turbine through a further branch of said fluid conduit, and a pump to pump preheated organic fluid mixture from said regenerative heater to said evaporator.

4. An electric power generating system as claimed in claim 3 wherein said super-heated gas has a maximum temperature of about 90° C. and said preheated organic fluid mixture is at a temperature of about 60° C., whereby said electric generator produces electricity at low temperatures and pressures while consuming minimum heat from said waste-heat boiler not to compromise the efficiency of said waste-heat boiler.

5. An electric power generating system as claimed in claim 4 wherein there are two or more of said regenerative heaters to enhance the thermal efficiency of said waste-heat boiler.

6. An electric power generating system as claimed in claim 3 wherein there is provided a multi-stage turbine having a plurality of turbines driven by said heated organic gas.

7. An electric power generating system as claimed in claim 1 wherein said fuel-fired burner is a natural gas burner.

8. A method of generating electric power using a quaternary refrigerant organic mixture of HFC134a, HCFC123, HCFC124 and HFC125 with proportions of 10% 70% 10% and 10%, by weight respectively, said method comprising the steps of:

i) feeding a waste-heat boiler, adapted to a Rankine cycle, with exhaust combustion products from a fuel-fired furnace to provide a thermal heat source for vapor regeneration of an organic heat exchange fluid mixture at a temperature higher than 90° C. circulated in a closed circuit for driving turbines of said Rankine cycle, and ii) driving a drive shaft of an electric generator by said turbines.

9. A method as claimed in claim 8 wherein there is further provided the step of reheating condensed organic fluid mixture in regenerative heating means to produce preheated organic fluid, and feeding said preheated organic fluid mixture to an evaporator located in said waste-heat boiler to produce heated saturated vapour by absorbing heat from said exhaust combustion products.

10. A method as claimed in claim 9 wherein there is further provided the steps of superheating said heated saturated vapour in said waste-heat boiler to operate a high-pressure turbine, and reheating in said waste-heat boiler extracted vapours from said high-pressure turbine to operate a low-pressure turbine, both said turbines being connected to said drive shaft of said electric generator.

11. A method as claimed in claim 10 wherein there is further provided the step of condensing low-pressure vapour from said low-pressure turbine and pumping same to said regenerative heating means.

* * * * *

UNITED STATES PATENT AND TRADEMARK OFFICE

CERTIFICATE OF CORRECTION

PATENT NO : 6,101,813
DATED : August 15, 2000
INVENTOR(S) : Samuel M. Sami et al.

It is certified that error appears in the above-identified patent and that said Letters Patent are hereby corrected as shown below:

The title of the patent should read:

ELECTRIC POWER GENERATOR USING A RANKINE CYCLE DRIVE AND EXHAUST COMBUSTION PRODUCTS AS A HEAT SOURCE

Signed and Sealed this

Seventeenth Day of April, 2001

*Attest:*

Nicholas P. Godici

NICHOLAS P. GODICI

*Attesting Officer*

*Acting Director of the United States Patent and Trademark Office*